United States Patent [19]

Niske

[11] Patent Number: 4,711,797

[45] Date of Patent: Dec. 8, 1987

[54] MATERIAL FOR PACKING CONTAINERS

[75] Inventor: Jörgen Niske, Lund, Sweden

[73] Assignee: Tetra Pak International AB, Lund, Sweden

[21] Appl. No.: 793,329

[22] Filed: Oct. 29, 1985

[30] Foreign Application Priority Data

Nov. 5, 1984 [SE] Sweden ..... 8405539

[51] Int. Cl.[4] ..... B32B 3/04; B31C 11/02

[52] U.S. Cl. ..... 428/35; 428/60; 428/153; 428/130; 493/287; 493/356

[58] Field of Search ..... 493/287, 291, 356, 370; 428/129, 130, 60, 153, 211, 35; 229/16 R, 17 R

[56] References Cited

U.S. PATENT DOCUMENTS

| | | | |
|---|---|---|---|
| 2,908,201 | 10/1959 | Hellberg | 409/132 |
| 2,982,186 | 5/1961 | McKeen | 493/362 |
| 2,996,959 | 8/1961 | Hellberg et al. | 409/64 |
| 3,010,260 | 11/1961 | Subklew | 51/78 |
| 3,073,216 | 1/1963 | Gaunt | 493/340 |
| 3,179,025 | 4/1965 | Schur | 493/364 |
| 3,408,776 | 11/1968 | Kalwaites | 51/324 |
| 3,420,421 | 1/1969 | Hellberg | 225/96 |
| 3,495,507 | 2/1970 | Haas et al. | 493/287 |
| 3,654,842 | 4/1972 | Schwenk | 493/287 |
| 3,779,786 | 12/1973 | Tone | 427/275 |
| 3,780,626 | 12/1973 | Hollier, Jr. | 51/74 R |
| 3,854,249 | 12/1974 | Fletcher | 51/75 |
| 4,540,391 | 9/1985 | Fries, Jr. | 493/287 |

FOREIGN PATENT DOCUMENTS

| | | |
|---|---|---|
| 177615 | 12/1961 | Sweden . |
| 178425 | 3/1962 | Sweden . |
| 190896 | 8/1964 | Sweden . |
| 227734 | 3/1971 | Sweden . |
| 923029 | 4/1963 | United Kingdom . |

*Primary Examiner*—John E. Kittle
*Assistant Examiner*—James J. Seidleck
*Attorney, Agent, or Firm*—Burns, Doane, Swecker & Mathis

[57] ABSTRACT

The invention relates to a material for packing containers comprising punched out blanks or a coherent web made up of a carrier layer of cardboard which on either side has a coating of thermoplastics. The carrier layer is reduced in thickness along selectively chosen regions in that parts of the carrier layer material are ground away and the regions of the blank or of the web which include the said thickness-reduced regions are folded over one another so as to form a so-called Z-fold wherein parts folded together are sealed to one another in order to form portions of rigid form, the total material thickness within the said ground portions of the Z-folded region A substantially corresponding to the thickness of the non-ground material.

14 Claims, 14 Drawing Figures

MATERIAL FOR PACKING CONTAINERS

FIELD OF INVENTION

The present invention relates to a material for packing containers of the type having a pattern of crease lines facilitating the folding of the blank or the web. The invention also relates to a packing container manufactured from the material.

BACKGROUND OF THE INVENTION

In packaging technique packages of the non-returnable type have been in use for a long time which are manufactured from a material which consists of a carrier layer of cardboard or paper and outer and inner coatings of thermoplastics. Frequently the packing material in such packages is also provided with additional layers of other material, e.g. aluminum foil or plastic layers other than those mentioned.

The composition of the packing material is intended to create the optimum product protection for the goods which are to be packed, and to impart sufficient mechanical protection for the product in the package and adapting it so that it can be readily handled by the user of the package. In order to achieve mechanical rigidity sufficient to provide mechanical protection for the contents and to make it possible for the package to be handled and gripped by hand without difficulty, the packages of this type are often provided with a carrier layer of paper or cardboard which gives the package rigidity of form and affords mechanical protection. Such a carrier layer, however, is permeable to gases or liquids and the rigidity of the material disappears if the material is subjected to moisture or if liquid is absorbed into the material. To make the material satisfactorily impermeable to liquids, it is most frequently laminated with a plastic material, and if this plastic material is thermoplastic, the plastic layers can be sealed to each other with the help of heat and pressure. In this manner, the packaging container can be sealed and given permanent form by the sealing of the plastic coated material panels to each other in a tight and mechanically durable and strong seal.

Packing containers of the type referred to here are manufactured either from blanks punched out beforehand or from a continuous web which has been prepared with suitable decoration and with a crease line pattern for facilitating its folding. The packing containers are manufactured from such a web by joining together the longitudinal edges of the web in an overlap join so as to form a tube which is subsequently filled with the intended contents and divided into closed container units by repeated transverse sealing of the tube perpendicularly to the longitudinal axis of the tube. After suitable folding of the packing material in the tube the material in the said container units is converted to the desired geometrical shape, usually a parallelepiped, by providing the tube with longitudinal folding lines and with double-walled triangular lugs at the corners of the packing container.

Whether the packing containers are manufactured from blanks produced beforehand or from a continuous web, the material, for practical reasons, will be of uniform thickness. This means that the material, and in particular the carrier layer of paper or cardboard, is mechanically overstrong or overdimensioned along certain regions which during normal use and handling are not subjected to more substantial mechanical stresses whilst other parts of the material in the package ought to be thicker or more rigid in order to withstand the mechanical strains which they are subjected to. In other words it would be desirable for the material to be of differential thickness so as to allow optimum economic utilization of the material.

SUMMARY OF THE INVENTION

The present invention provides a material for packing containers having differential rigidity and provides how such material is to be manufactured and used.

A material web in accordance with the present invention comprises a carrier layer of paper material such as cardboard and coatings of thermoplastic material at opposite sides of the carrier layer, wherein the material web is provided with a plurality of crease lines and the carrier layer includes abraded regions which have a reduced thickness relative to other regions of the carrier layer. By such arrangement, selected portions of the web may be triple-folded without making the container wall excessively thick at the abraded regions.

BRIEF DESCRIPTION OF THE DRAWINGS

Preferred embodiments of the present invention will be described in the following with reference to the drawing, wherein.

As mentioned previously it is desirable to utilize the material in a package in the best possible manner and this is perhaps particularly desirable in the manufacture of the mass-produced non-returnable packages which are used for the packaging of milk and fruit juices. Owing to the high degree of mechanization and rapid rate of production in the manufacture of this type of package, the cost of material represents a very substantial part of the total cost of the package so that great profits can be made by saving material e.g. by rendering the utilization more effective. One such more effective utilization of the material can be achieved if the quantity of material used is chosen so that more material is used in those parts of the package which must be strong or rigid whilst smaller quantities of material, that is to say thinner material, is used along those parts of the package which are not required to have great rigidity or strength. This means that the material ought to be of differential thickness which can be achieved for example by glueing separate reinforcement panels onto the material blanks. This procedure, which is known, is troublesome in that its realization is so expensive that any savings achieved by the more effective utilization of the material properties is spent through the extra cost of manufacturing the material.

Another method for solving the problem of differential strength of a package is based on folding the material in an overlap fold so as to form a so-called Z-fold wherein three layers of material will overlap one another. A part of the wall in a package with such a Z-folded portion will have substantially greater rigidity than surrounding portions of the package wall, but it has the disadvantage that the material within the folding region will also have treble thickness which poses a great problem in the realization of liquid-tight seals of the packing material. The problem arises in that leakage channels are created in the sealing joins at the transition between thinner and thicker parts of material and for this reason it has not been possible to apply so-called Z-folding in liquid packages to any great extent. Another problem in connection with Z-folds is the difficulty in performing folds in the material over these portions of the material which have been thickened through Z-folding.

The solution of this technical problem is to Z-fold the material so as to obtain the desirable advantages from the point of view of strength, but to make the material selectively thinner through active machining, preferably grinding or milling, along those portions of the material where foldings are to be performed or where sealing joins are to be located.

Figure 1:
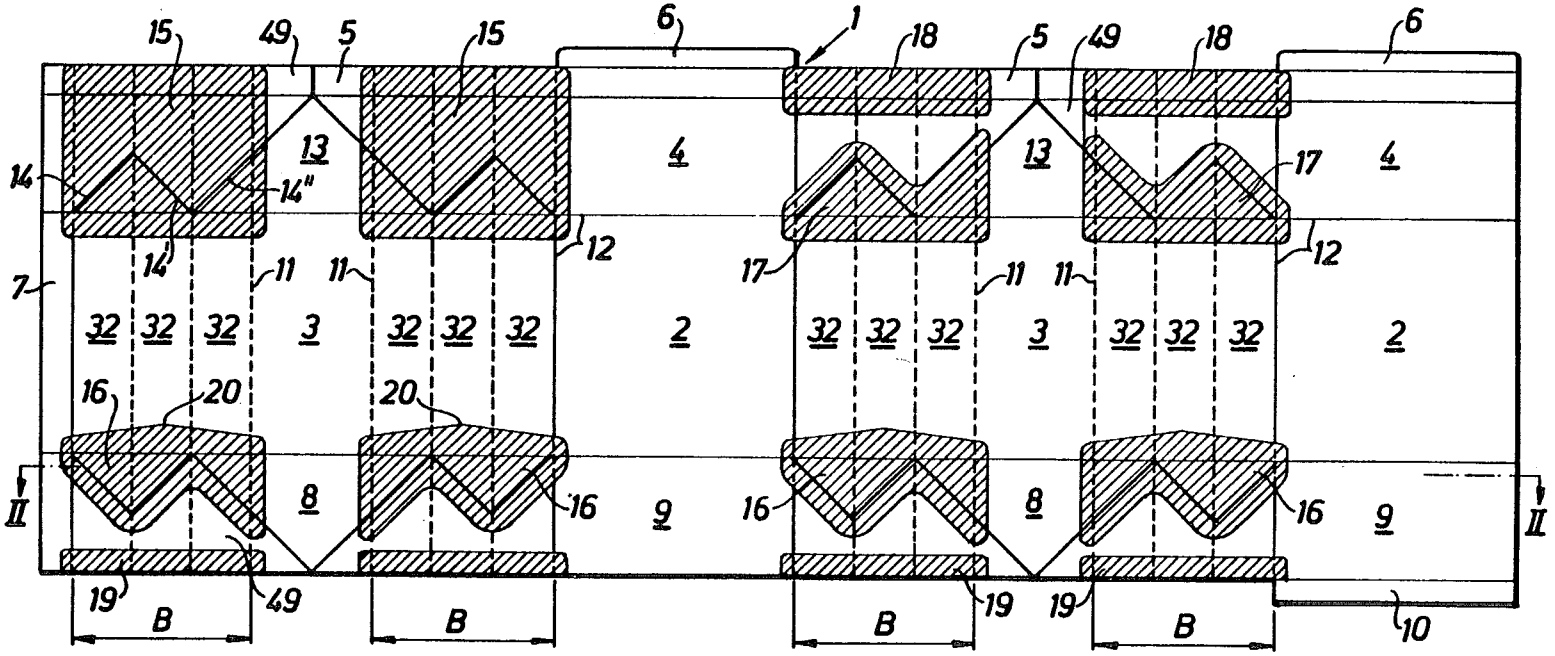
FIG. 1 is a planar view of a blank for a packing container according to a preferred embodiment of the present invention.

Referring to FIG 1, an original blank 1 for a packing container has been punched out of a sheet or a web of cardboard material of constant thickness. The blank 1 is divided by a pattern of crease lines into side wall panels or spaces 2 and 3, top closure panels 4 and 13 and bottom sealing panels 8 and 9. The top sealing panels 13 and bottom sealing panels 8 are triangular and are arranged so as to be folded in a bellow-like manner in between the top closure panels 4 and the bottom sealing panels 9 respectively. As the triangular panels 13 and 8 are folded in this way the adjoining panels 49 are folded back in such a manner that they come to lie between panels 4 and 13 and panels 9 and 8 respectively. This top and bottom design is found generally on so-called "gable-top" packages.

In principle the blank is formed into a package by being formed into a tube of square or rectangular cross-section and by the short sides of the blank 1 being joined together such that a longitudinal join panel 7 is combined in an overlap join with the corresponding short side of the blank 1. After the blank has been formed to a tube of square or rectangular cross-section it is threaded onto a mandrel in a packing machine not shown in the drawing. While the tubelike blank is on the mandrel the bottom wall panels 8 and 9 are folded in over each other in the manner indicated above whereupon the bottom panels are sealed to one another in that the thermoplastic coatings of portions lying against each other are made to fuse together through the application of heat and pressure. To stabilize the bottom seal one of the bottom wall panels 9 is provided with a sealing lug 10 which during the bottom sealing will overlap the outer edge of the outer bottom wall panel 9.

When the bottom seal has been completed the container formed is drawn off the mandrel and filled with the intended contents whereupon the top is closed by flapping down the top closure panels 13 and 4 over the opening of the container with the triangular panels 13 located inbetween the outer rectangular panels 4. When this top panel folding is carried out the sealing panels 5 will be collected side by side in a sealing fin comprising four material layers. By compressing these sealing panels while supplying heat, the thermoplastic coatings provided on the surfaces of the panels are made to melt and are combined with each other so as to form a liquid-tight and durable sealing join. The top sealing panels 6 adjoining the rectangular panels 4 will also be joined to one another in a sealing join which will lie above the sealing join 5. The finished packing container 44 where the said sealing join is designated 45 is shown in FIG. 12.

However, the blank shown in FIG. 1 cannot be formed directly to a package 44 in the manner as described above. In the case assumed here a greater gripping rigidity of the package is desirable which means in principle that one or both of the "gripping sides" 50 of the package (that is to say the sides over which a grip by hand is applied on handling the package which normally will be the side walls 3 which adjoin the triangular top closure panels 13) are provided with reinforcing beams in the form of Z-folded sealed portions 28 (FIG. 12).

Figure 12:
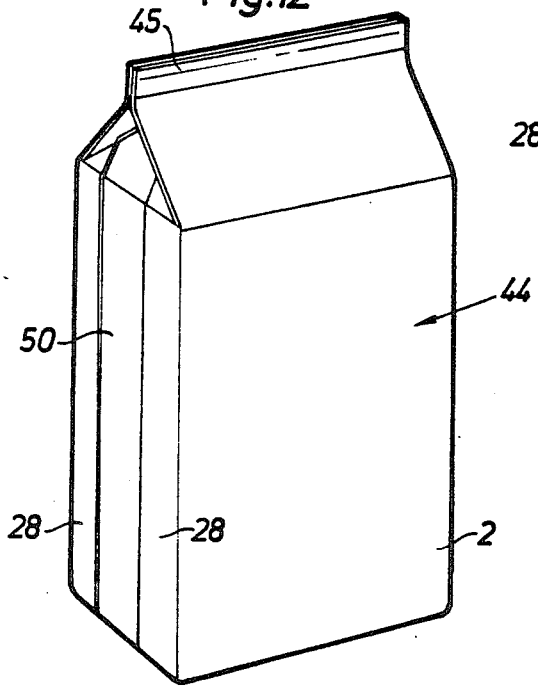
FIG. 12 is a perspective view of a finished packing container of the type which is manufactured from a blank of packing material.

It is possible that in other cases and for other purposes the reinforcing Z-folded portions are arranged on other parts of the package, but in the embodiment assumed here it is the object to arrange the reinforcing portions or beams 28 in the manner as shown in FIG. 12 and so that both the sides 50 facing each other are to be reinforced. In order to achieve this the package blank 1 (FIG. 1) is realized and treated in the following manner:

The parts of the blank 1 which are to be folded together in a Z-pattern so that three material layers are formed along the Z-folded portions have to be dimensioned so that they are of a width which is three times greater than the width of the Z-folded portion in the finished package blank 1. In FIG. 1 these portions which are to be Z-folded are designated B and the wall panels which are to be folded up and joined to one another by heat-sealing are designated 32. For the realization of the Z-fold folding lines, so-called crease lines 11, have to be prepared in the material and these folding lines 11 are realized either in such a manner that the material is "crushed" or permanently deformed through linear indentations or else the crease lines can be carried out in such a manner that material is removed through grinding or milling.

If the Z-folds are to be carried out on a material of uniform thickness the increase in rigidity would certainly be achieved, but it would be impossible to fold the package blank and it would also be practically impossible to obtain liquid-tight joins on the finished package. Hence the blank 1 has to be machined prior to the Z-folding in a manner described earlier in priciple, that is to say selected parts of the blank have to be reduced in their thickness so that the total thickness of the material in the folding zones and sealing zones does not substantially exceed the normal thickness of the blank. To achieve this the blank 1 is thickness-reduced along the zones marked by hatching in such a manner that the thickness within the zones is only approx. ⅓ of the normal material thickness of the blank. The thickness reduction is realized with the help of a grinding process which will be briefly outlined later. How large the ground zones are to be and which parts of the blank they are to comprise must be decided from case to case and depends on the properties desired of the finished packing container. In FIG. 1 a slightly different grinding pattern is shown on the lefthand part of the blank 1 compared with its righthand part. The reason for this difference is not that one or the other grinding pattern is to be preferred but only to give an example showing that the grinding pattern can be varied and that the invention is not limited to a certain grinding pattern.

It is evident that the hatched portions 15,16,17,18 and 19 shown in FIG. 1 on the one hand comprise the regions of the blank 1 which are to be sealed together to form a tight sealing join and on the other hand those regions which comprise crease lines along which the blank 1 is to be folded. Naturally the extent of the said ground portions (hatched portions) is limited to the Z-folding regions B but owing to the edges of the grinding zones not being sharp and having a relatively large transition zone between full material thickness and full grinding depth the grinding zones 15–18 must be of an extent somewhat beyond the Z-folding region proper which is clearly evident from the Figure. As mentioned previously the ground regions i.e. the thickness-reduced regions may be designed in different ways. In the top lefthand corner of FIG. 1 is shown how the sealing panels 5 and the crease line pattern 14, are contained in one and the same grinding region 15 whereas in the corresponding righthand corner of the blank 1 the corresponding region is divided into two separate grinding regions 17 and 18. In the same manner, as will be described in detail later, the grinding area in FIG. 8 has been divided into separate or coherent parts. The method which is to be used will depend partly on problems of grinding technique connected with the appearance of the grinding regions, quality of the grinding equipment and grindability of the material.

As is evident from FIG. 1 the coverging crease lines which limit the top closure panel 13, that is to say the crease lines 14, are divided into a number of crease line parts 14,14' and 14''. The reason for this division is that the crease lines 14 are situated within the Z-fold region and that the crease line parts should coincide with one another only when the Z-folding has been carried out.

When the blank 1 has been machined by means of thinning down of the hatched portions 15–18 in the manner described above, the ground side of the blank is coated with a thermoplastic layer (if desired, the opposite side may be plastic-coated already prior to the grinding operation) preferably through extrusion of a molten plastic layer. It would also be possible to laminate upon the ground side of the blank a premanufactured plastic film such as one with a gas-tight barrier layer of aluminum foil or the like. Other suitable processes and materials for coating the blank would be readily apparent to one of ordinary skill in the art upon his becoming familiar with this disclosure. After coating the ground blank 1 with plastic the Z-folding mentioned earlier is carried out by folding the panels 32 along the crease lines 11 in the manner as shown in FIGS. 3, 4 and 5.

Figure 3:
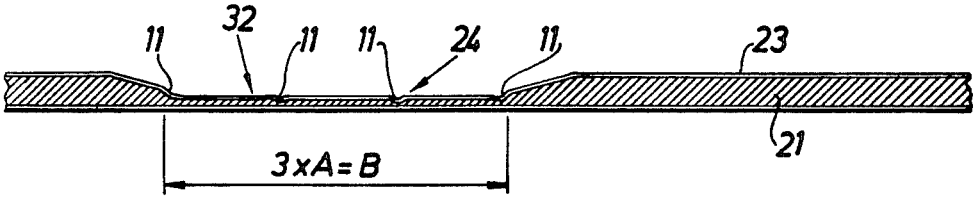
FIG. 3 is a greatly enlarged section of a part of the thickness-reduced material by grinding.
Figure 4:
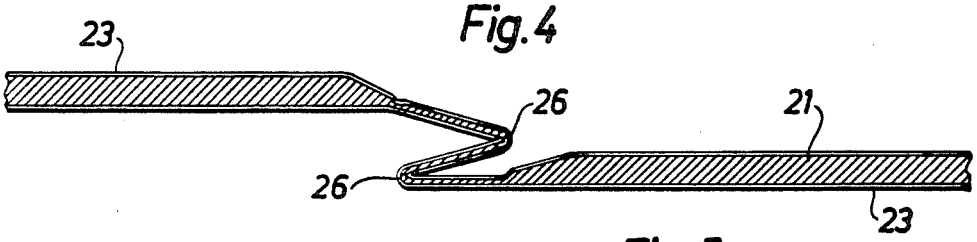
FIG. 4 is a view of how the said thickness-reduced part according to FIG. 3 is folded up to a so-called Z-joint.

In FIG. 3 is shown a section of a ground Z-fold region. For practical reasons the scale of the illustration in vertical direction has been enlarged relative to the scale of the illustration in horizontal direction. The carrier layer of the material is designated 21 and the plastic coatings 23. The portion B thinned through grinding is of a width which corresponds to 3 times the width of the finshed Z-folded portion A that is to say the width of the panels 32. As mentioned previously the lateral boundaries of the ground portion like its boundaries in grinding direction do not have sharp and will-defined edges but the ground portion gradually passes over to full material thickness. Within the ground portion B crease lines 11 are provided to facilitate the Z-folding and as can be seen in FIG. 4 the material is folded along these crease lines so as to form folding points 26. When the Z-folding has been completed and the panels 32 have been placed on top of one another the layers in the Z-fold are joined together by heating the thermoplastic layers which cover the panels 32 to sealing temperature at the same time as the layers in the Z-folding regions are pressed together so that a coherent and rigid wall beam is formed.

Figure 5:
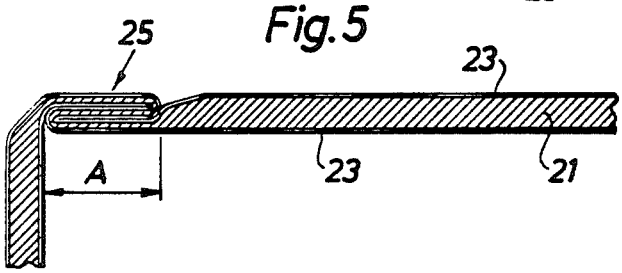
FIG. 5 is a view of how the folded-up part according to FIG. 4 is sealed together.

In FIG. 5 is shown the finished Z-fold in a cross-section taken along a thickness-reduced region (along the regions of the Z-folding region not reduced in thickness the Z-folded portions will of course present threefold material thickness so as to form a rigid beam), the Z-folded region A being designated 25.

Figure 2:
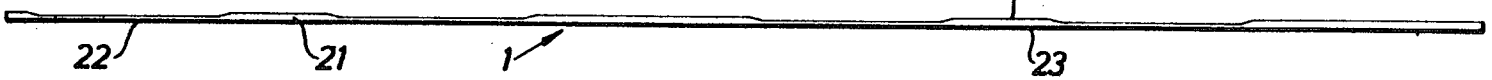
FIG. 2 is a transverse section of the same blank taken along line I—I.

In FIG. 2 a cross-section of the machined but not Z-folded blank 1 is shown, the portions which have been reduced in thickness through grinding being marked 22 while the unmachined portions are designated 21. To obtain the desired effect the thickness of the layer 22 must be approximately one third of the thickness of the layers 21.

Figure 6:
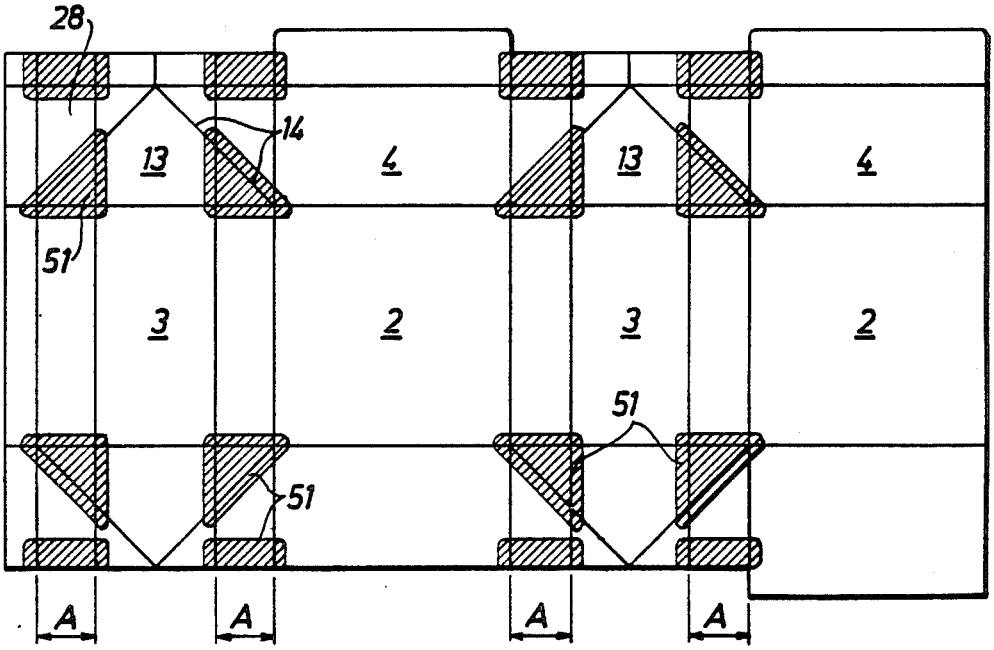
FIG. 6 is a planar view of a blank for packing containers manufactured according to a preferred embodiment of the present invention by Z-folding and joining together of thinned portions of material.

In FIG. 6 is shown a blank 27 which has already been Z-folded to form Z-folded panels 28. The width of the Z-folded region equal A, which, as mentioned above, is a third of the width B of the ground portions of the Z-fold region. It will be further noticed in FIG. 6 that the crease lines 14 which delimit the triangular top closure panel 13 coincide with one another after Z-folding and that the said crease lines 14 are located within the thickness-reduced parts of the Z-fold region which in FIG. 6 is marked 51 (hatched regions).

Figure 7:
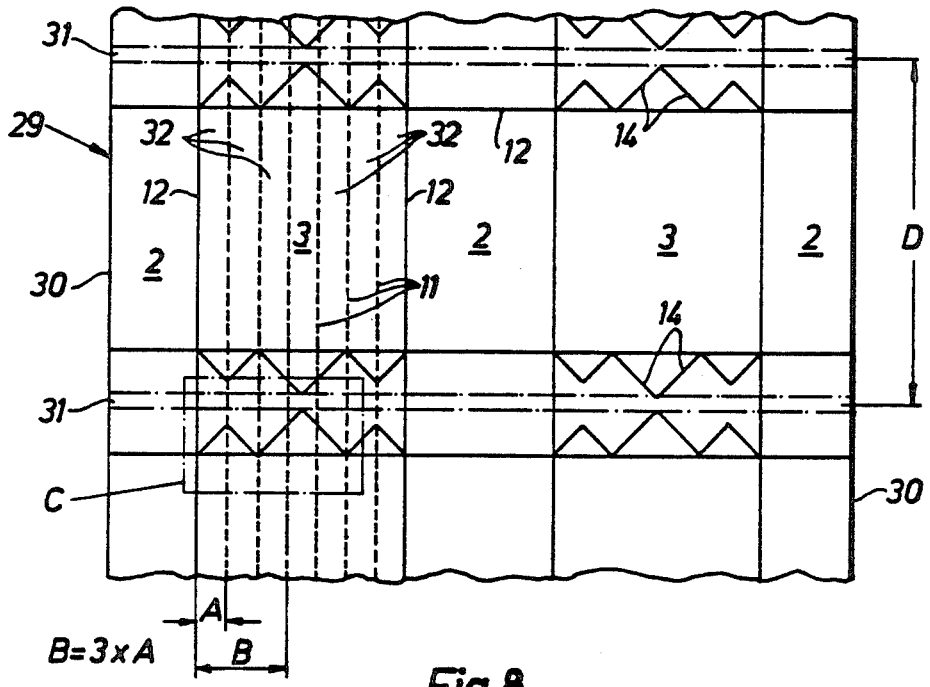
FIG. 7 is a planar view of a web of packing material according to another preferred embodiment of the present invention with a pattern of crease lines which facilitate the folding of the material.

As mentioned previously, the material may also be constituted of a continuous web 29 which is shown in FIG. 7. As pointed out in the introduction, the packages are manufactured from such a web by forming the web into a tube so that the longitudinal edges of the web are joined to one another, whereupon the tube is filled with the intended contents and divided up to individual packing containers by transverse sealing of the filled tube, shaping of the package and finally separating of the packing containers by cutting through the transverse sealing zones.

A packing material web 29 of the type referred to here, like the blanks 1 discussed previously, is provided with a crease line pattern to facilitate the forming of the package by folding. For the sake of clarity the same reference numerals have been used for corresponding parts of the blank 1 and the web 29. Thus the side walls of the package in FIG. 7 have been designated 2 and 3 and the crease lines of the Z-fold have been marked 11. The outer edge 30 of the web 29 is intended to be make to overlap the opposite web edge in a longitudinal sealing join and for this reason the combined width of the outer panels 2 is somewhat greater than the width of the central panel 2. A full package length is designated D, and there is a region 31 between complete decorations or crease line patterns for one packing unit which is a common sealing region for successive packages. The final separation of the packages takes place by means of a cut through this sealing zone within the regions of the corresponding panel 31. The design of the Z-fold panels, like the design of the crease line pattern 14 is the same as in the example described earlier.

Figure 8:
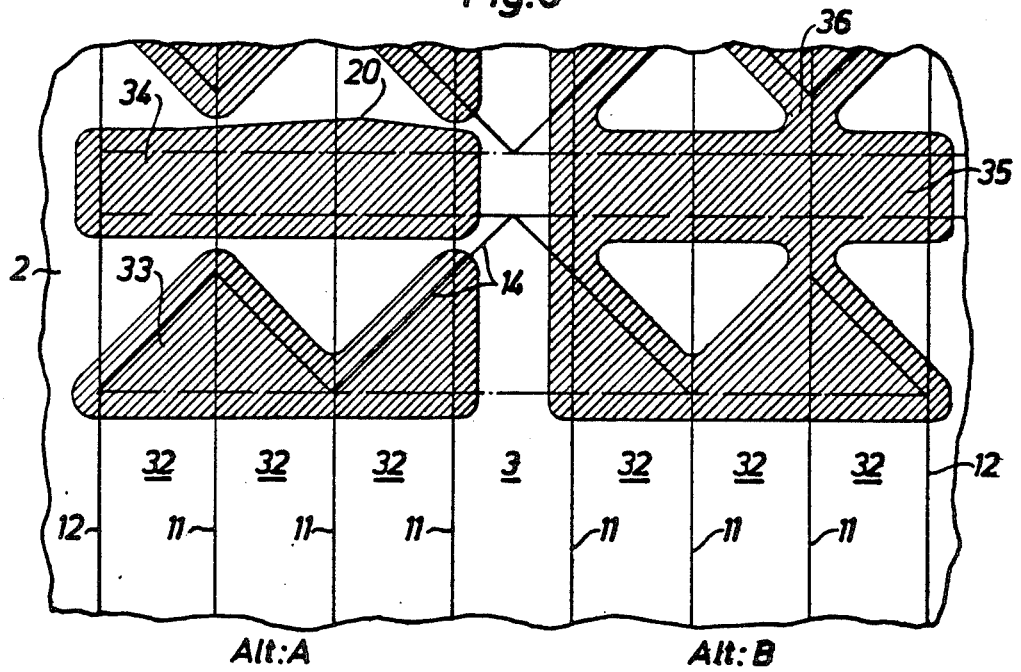
FIG. 8 is an enlarged view of section C of the web according to FIG. 7.

FIG. 8 is an enlargement of a circled portion C of FIG. 7 and in FIG. 8 the portions 33,34 and 35 thinned by means of grinding have been marked by hatching. As can be seen the principle is the same as in the realization of the appearance of the ground portions for a package blank, i.e. the parts which comprise crease lines or sealing zones are to be thinned so that the resulting thickness after Z-folding along the folding lines 11 does not substantially exceed the normal thickness of the material, i.e. the thickness of non-ground and non-Z-folded portions. It has been mentioned earlier that the pattern of the portions 33–35, machined by grinding and thickness-reduced, either may be divided into separate regions 33,34 or be combined to a common region 35 where the points of connection between the regions are marked 36.

Figure 13:
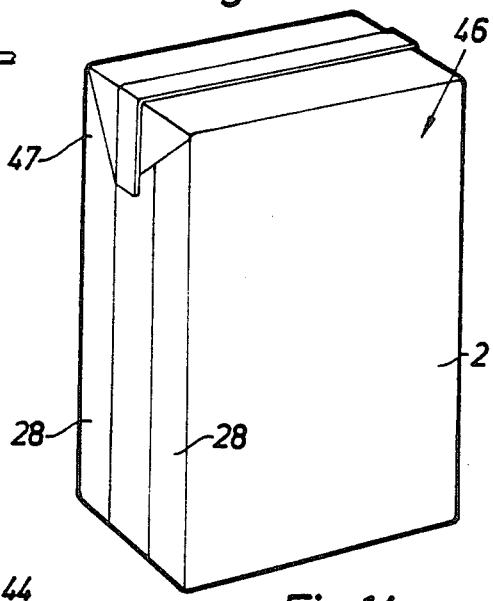
FIG. 13 is a perspective view of a packing container of the type which is manufactured from a continuous web of packing material.

A package manufactured from the packing material web 29 is shown in FIG. 13. The reinforced Z-folded zones 28 are located at the short sides of the package so as to allow a grip by hand to be applied over the package when it is to be used. The package is provided with double-walled triangular lugs 47 at its corners which are formed with crease lines 14. In order to make possible the fold-forming of the lugs 47, the Z-folded material in the lug region has to be thickness-reduced in the manner as described herein.

Figure 10:
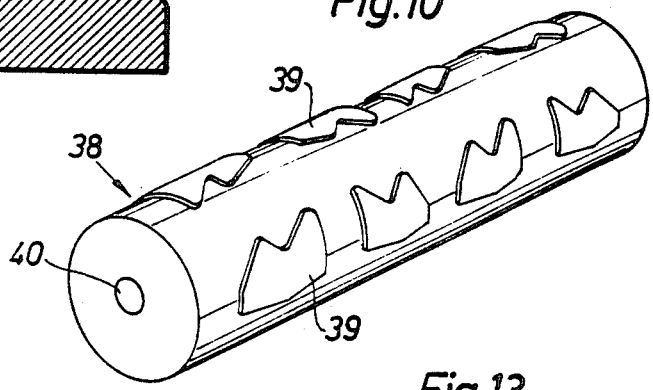
FIG. 10 is a perspective view of a carrier roll for grinding dies.
Figure 11:
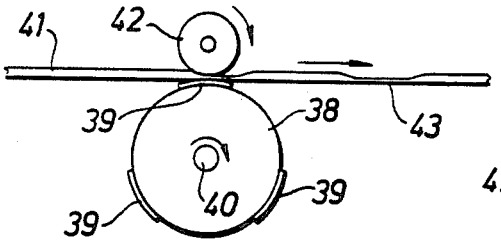
FIG. 11 is a side view of an arrangement for the carrying out of the grinding operation.

The realization of the grinding or milling operation may take place with the help of auxiliary means and methods known to the applicant. One such method specially suitable for this purpose passes the web or sheet which is to be worked and locally ground down over a roll 38 which rotates with the web around as axle 40. Referring to FIG. 10, raised portions or dies 39 are provided on the surface of the roll 38 which are of a shape corresponding to the shape of the thickness-reduced regions desired. Similarly the mutual placing of the dies 39 on the roll is adapted so that it corresponds to the desired mutual placing of ground regions on the blank 1 or the web 29 respectively.

Figure 9:
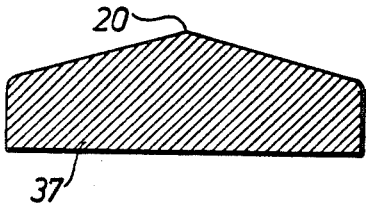
FIG. 9 is a planar view of a panel of the material, ground so that the thickness of material within the panel is substantially reduced.

Adjacent the roll 38 is arranged a rapidly rotating grinding or milling wheel 42 which preferably is made to rotate in the direction of feed of the material but which may also rotate in the opposite direction (depending upon the design of the grinding wheel). The distance between the roll surface and the working edge of the grinding wheel is adjusted until it corresponds to, or slightly exceeds, the normal thickness of the material, which means that the material can pass under the grinding wheel without being worked by the latter. On rotation of the roll 38, which takes place synchronously with the feed of the material web 41, the raised portions or dies 39 on the roll will press the web 41 against the grinding wheel 42 and the material over the dies 39 will be ground away. Through adaptation of the thickness of the dies 39 the depth of grinding on the material can be accurately determined. It has been found that the grinding produces a well-defined grinding surface except for a transition zone always appearing between material with full grinding depth and material of full thickness. One phenomenon which has been observed, however, is that the grinding edge becomes uneven and shows "edge burrs" when the grinding wheel release contact with the material along a line which runs parallel with the axis of the grinding wheel. In order to avoid this disadvantage, the rear edge lines in the direction of feed of the grinding region either have to be adapted so as to form an angle with the axis of rotation of the grinding wheel or else the grinding regions have to be designed in the manner as shown in FIG. 9 i.e. their rear edge terminating in a point 20 which means that the grinding wheel gradually releases contact with the grinding region 37 finally to lose contact with the material 41 completely at the point 20. If the grinding is carried out in this manner, an even and clean-edge grinding will be obtained.

Figure 14:
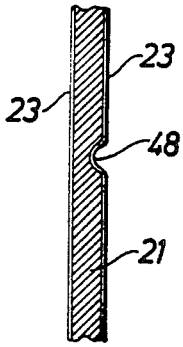
FIG. 14 is a cross-section through a material panel having a crease line which has been produced by grinding of the material.

Referring to FIG. 14, the crease lines 48 facilitating the folding can also be ground which implies that material is removed in the regions of the crease lines instead of the fibres in the cardboard or paper material being crushed and a permanent deformation along the crease line pattern being created. It is possible to make ground crease lines in such a manner that the folding is greatly facilitated in comparison with conventional crease lines but they do represent a certain weakening of the material.

By using the material and the method in accordance with the present invention substantial savings can be made. The total surface of a blank which is to be Z-folded will of course be greater than a normal package blank but by being able to use a thinner material a total reduction in the amount of material consumed in the package manufacture will be achieved at the same time as selected portions can be made stronger and more rigid whilst portions which do not have to be strong or rigid can be made selectively weaker.

The description given here has as its purpose only to indicate some examples of the application of the invention while it is to be understood that there can be a number of other embodiments of packages where a material in accordance with the invention can be used.

Thus, it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing description and all changes or variations which fall within the meaning and range of the claims are therefore intended to be embraced therein.

What is claimed is:

1. A material web for packing containers comprising a carrier layer of paper material and outer and inner coatings of thermoplastic material at opposite sides of said carrier layer, said material web being provided with a pattern of crease lines, said carrier layer including abraded regions each having a reduced thickness relative to other regions of said carrier layer, said abraded regions each further having a rear edge which is tapered in a direction of grinding.

2. The material web in accordance with claim 1, wherein the crease line pattern includes abraded grooves in the carrier layer.

3. The material web in accordance with claim 1, wherein at least portions of said crease line pattern are located in the abraded regions.

4. The material web in accordance with claim 1, wherein selected portions of the material web are adapted to form Z-folded reinforcing panels, abraded regions being located in said selected portions, whereby when the said selected portions are Z-folded together the reinforcing panel will have at said abraded regions a total thickness which approximately equals the thickness of the material web at said other regions of the carrier layer.

5. The material web in accordance with claim 1, wherein said abraded regions of the carrier layer are of a thickness which is in the range of 30 to 50% of the thickness of said other regions of the carrier layer.

6. The material web in accordance with claim 1, wherein said abraded regions are formed by grinding paper material from a surface of said carrier layer.

7. The material web in accordance with claim 6, wherein said paper material includes cardboard.

8. The material web in accordance with claim 6, wherein said material web is a punched-out blank.

9. The material web in accordance with claim 6, wherein said material web is continuous.

10. The material web in accordance with claim 6, wherein members of said abraded regions are spaced from edges of said material web.

11. The material web in accordance with claim 1, wherein said outer and inner coatings of thermoplastic material are provided on opposite sides of said abraded regions such that a thermoplastic coating is provided between portions of said material web that are adapted to lie against each other upon a folding of said material web so as to enable the portions to be fused together.

12. A material web for packing containers comprising a carrier layer of paper material and outer and inner coatings of thermoplastic material at opposite sides of said carrier layer, said material web being provided with a pattern of crease lines, said carrier layer including abraded regions having a reduced thickness relative to other regions of said carrier layer, selected portions of said material web being adapted to form Z-folded reinforcing panels, abraded regions being located in said selected portions, whereby when said selected portions are Z-folded together the reinforcing panel will have at said abraded regions a total thickness which approximately equals the thickness of the material web at said other regions of said carrier layer, said crease line pattern including abraded grooves in said abraded regions located in said selected portions for forming top and bottom lugs.

13. A packing container of the type that is manufactured from a material web having a carrier layer and thermoplastic coatings on opposite sides of the carrier layer, the improvement comprising said web being folded with several layers of the material web overlapping one another, selected regions of the overlapping material having reduced thicknesses relative to other regions of the material web, said thermoplastic coatings also being provided on opposite sides of said selected regions of said overlapping material such that a thermoplastic coating is provided between said several layers overlapping one another to enable the layers to be fused together with said thermoplastic coating whereby the thickness of said folded portions along said selected regions approximately equals the thickness of the packing container wall along said other regions.

14. The packing container according to claim 13, wherein members of said selected regions are spaced from edges of said material web.

* * * * *